US006729172B2

(12) United States Patent
Aizaki

(10) Patent No.: US 6,729,172 B2
(45) Date of Patent: May 4, 2004

(54) METHODS AND APPARATUS FOR MANUFACTURING PRESS FORMED ARTICLES

(75) Inventor: Jiro Aizaki, Toyota (JP)

(73) Assignee: Araco Kabushiki Kaisha (JP)

( * ) Notice: Subject to any disclaimer, the term of this patent is extended or adjusted under 35 U.S.C. 154(b) by 0 days.

(21) Appl. No.: 10/266,412

(22) Filed: Oct. 8, 2002

(65) Prior Publication Data

US 2003/0066329 A1 Apr. 10, 2003

(30) Foreign Application Priority Data

Oct. 10, 2001 (JP) ..... 2001-313094

(51) Int. Cl.[7] ..... B21D 28/10

(52) U.S. Cl. ..... 72/329; 72/327; 29/893.34; 83/51

(58) Field of Search ..... 72/325, 326, 329, 72/330, 327; 29/893.33, 893.34; 83/51

(56) References Cited

U.S. PATENT DOCUMENTS

| | | | | |
|---|---|---|---|---|
| 1,434,190 A | * | 10/1922 | Bird | 72/329 |
| 3,211,034 A | * | 10/1965 | Andris | 72/329 |
| 3,878,746 A | * | 4/1975 | Carmeli | 83/51 |
| 4,362,078 A | * | 12/1982 | Ohnishi et al. | 83/51 |
| 4,433,568 A | | 2/1984 | Kondo | 72/334 |
| 4,477,537 A | * | 10/1984 | Blase et al. | 83/51 |
| 4,586,360 A | | 5/1986 | Jürgensmeyer et al. | 72/328 |
| 4,711,115 A | * | 12/1987 | Sukonnik et al. | 72/327 |
| 5,237,745 A | | 8/1993 | Yamanaka | 72/68 |
| 6,125,527 A | * | 10/2000 | Sunaga | 72/334 |

FOREIGN PATENT DOCUMENTS

| | | |
|---|---|---|
| JP | 04-091826 | 3/1992 |
| JP | 06-039453 | 2/1994 |
| JP | 06-344049 | 12/1994 |
| JP | 07-112234 | 5/1995 |
| JP | 09-248646 | 9/1997 |

* cited by examiner

*Primary Examiner*—Daniel C. Crane
(74) *Attorney, Agent, or Firm*—Patterson, Thuente, Skaar & Christensen, P.A.

(57) ABSTRACT

Methods for manufacturing a press formed article (22) may include half die cutting a substantially flat material (1, 10) by press forming, thereby forming a first processed material (10') having a first intermediate press formed article (16) defined therein. The half die cutting step is preferably performed while simultaneously compressing the central portion of the material in order to induce outward plastic flow within the first intermediate press formed article. These methods optionally may include pressing the first intermediate press formed article back into the first processed material, thereby forming a second processed material (10") having a second intermediate press formed article (20), and separating the second intermediate press formed article from the second processed material, thereby forming a final processed material (10'") and an unfinished press formed article (22').

13 Claims, 10 Drawing Sheets

METHODS AND APPARATUS FOR MANUFACTURING PRESS FORMED ARTICLES

This application claims priority to Japanese Patent Application Serial Number 2001-313094, the contents of which are incorporated herein by reference.

BACKGROUND OF THE INVENTION

1. Field of the Invention

The present invention relates to methods and apparatus for manufacturing a press formed article from a sheet material. More particularly, the present invention relates to methods and apparatus for manufacturing a press formed article, e.g., a ring gear, from a disk-like sheet metal.

2. Description of the Related Art

A method for manufacturing a press formed article is taught, for example, by Japanese Laid-open Patent Publication Number 9-248646, in which a ring gear is exemplified as a press formed article that can be prepared utilizing the known method. In this known art, a sheet material is clamped between upper and lower dies of a first press forming machine. Thereafter, a punch associated with the upper die is lowered toward a corresponding die opening defined within the lower die, so as to stamp out an intermediate ring gear (i.e., an intermediate product). At the same time, gear teeth are formed around the outer periphery of the intermediate ring gear. However, burrs or fins are also formed around the intermediate ring gear and the burrs or fins project along the stamping direction. In addition, each of the gear teeth of the intermediate ring gear may have a dull upper edge or shear drop due to shearing. Therefore, the intermediate ring gear is reversed or turned over and is clamped between upper and lower dies of a second press forming machine or reshaping machine. Thereafter, a punch associated with the upper die is lowered toward a corresponding die opening defined within the lower die such that the intermediate ring gear is reversibly squeezed or reshaped, to thereby form the ring gear (i.e., the final product) having a desired shape and size.

According to this known method, when the intermediate ring gear is squeezed, the burrs may be compressed and partially move into the gear teeth as a result of plastic flow caused by plastic deformation. As a result, the burrs may effectively be removed. At the same time, the shear drop of the teeth may be reshaped and raised.

However, the teeth shear drop once produced typically can not be sufficiently or completely reshaped and raised using the known method due to reduced plastic flow characteristics or low plastic deformability of the material. Such insufficient raising of the teeth shear drop may result in an inferior quality ring gear.

SUMMARY OF THE INVENTION

It is, accordingly, one object of the present teachings to provide improved methods and apparatus for manufacturing a press formed article.

In one embodiment of the present teachings, methods are taught for manufacturing a press formed article. For example, a substantially flat material may be half die cut by press forming, to thereby form a first processed material having a first intermediate press formed article defined therein. The half die cutting step may be performed while compressing the central portion of the material in order to cause or induce outward plastic flow within the first intermediate press formed article. Optionally, the first intermediate press formed article may be pressed back into the first processed material, to thereby form a second processed material having a second intermediate press formed article. Further, the second intermediate press formed article may be pushed off or separated from the second processed material, to thereby form a final processed material and an unfinished press formed article.

In another embodiment of the present teachings, the unfinished press formed article may be subsequently stamped in order to form an opening therein.

According to the present teachings, when the first intermediate press formed article is half die cut, the peripheral edge of the first intermediate press formed article may simultaneously be raised due to the plastic flow caused by plastic deformation of the material. Therefore, dull edges or shear drops are not substantially produced in the first intermediate press formed article. Consequently, it is not necessary to reform the first intermediate press formed article and it is possible to efficiently increase the quality of the press formed article.

Other objects, features and advantage of the present invention will be ready understood after reading the following detailed description together with the accompanying drawings and the claims.

DETAILED DESCRIPTION OF THE INVENTION

Figure 1:
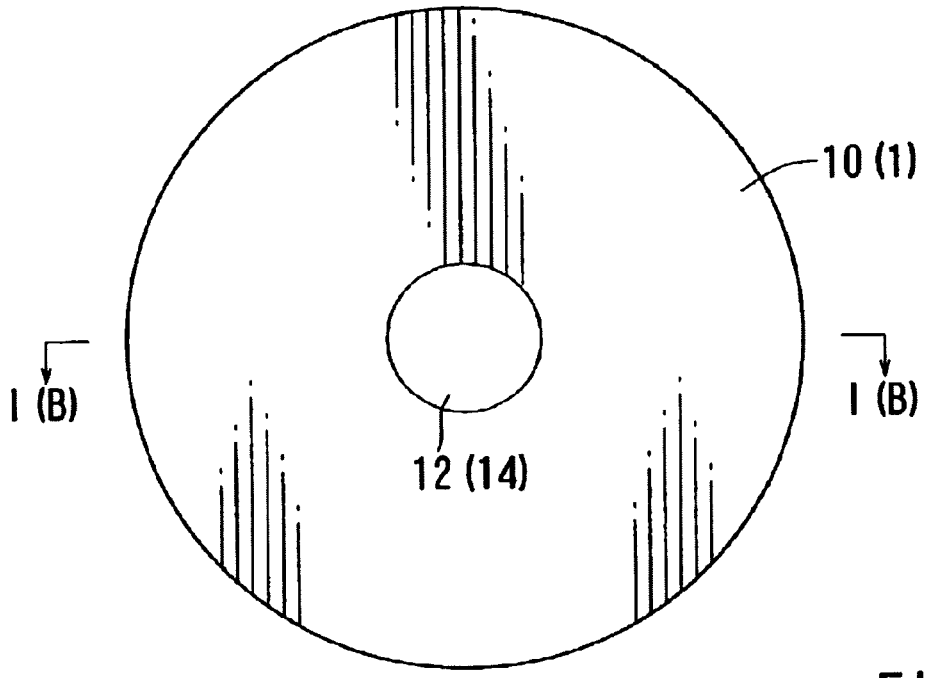
FIG. 1(A) is a plan view of a representative pierced material disk according to a representative embodiment of the present teachings.
FIG. 1(B) is a cross-sectional view taken along line I(B)—I(B) shown in FIG. 1(A)
Figure 1:
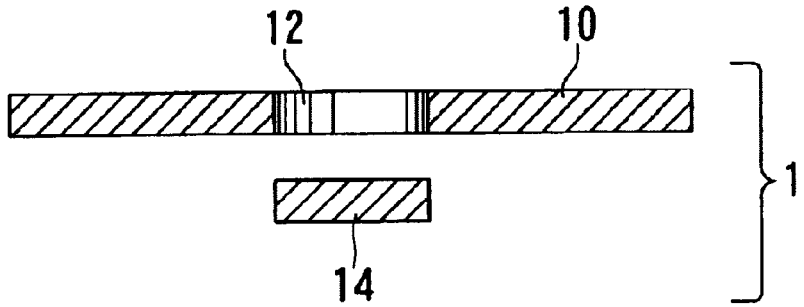
Figure 2:
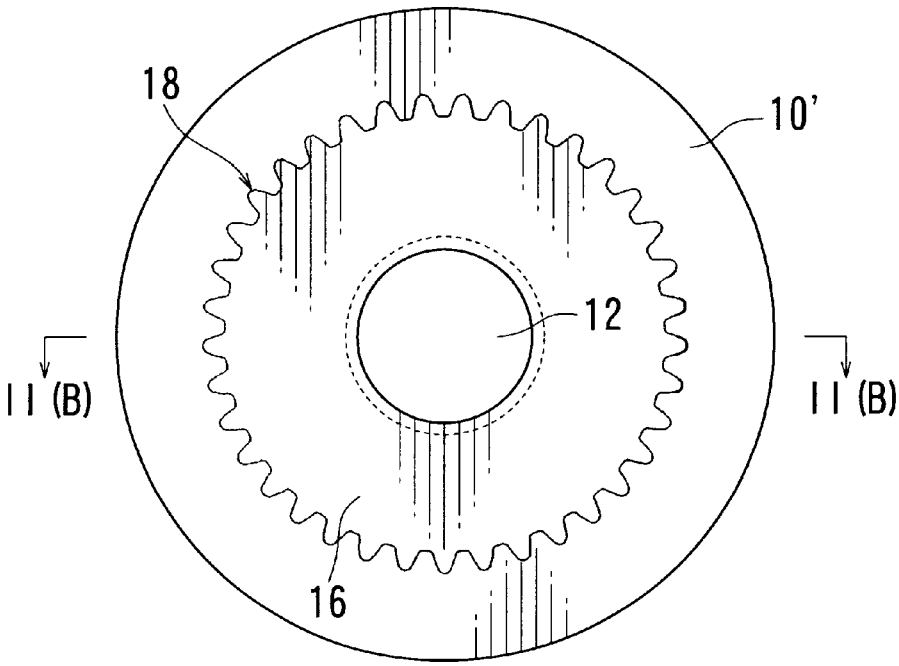
FIG. 2(A) is a plan view of a representative first processed pierced material disk having a first intermediate ring gear defined therein.
FIG. 2(B) is a cross-sectional view taken along line II(B)—II(B) shown in FIG. 2(A)
FIG. 2(C) is a partially enlarged view of FIG. 2(B)
Figure 2:
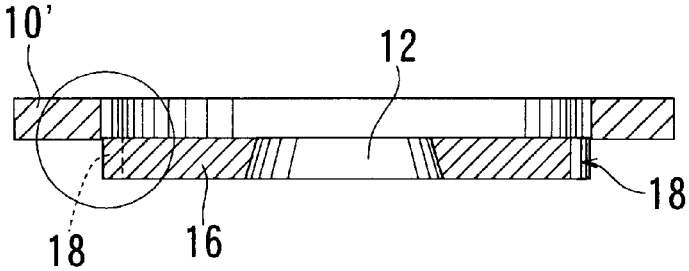
Figure 2:
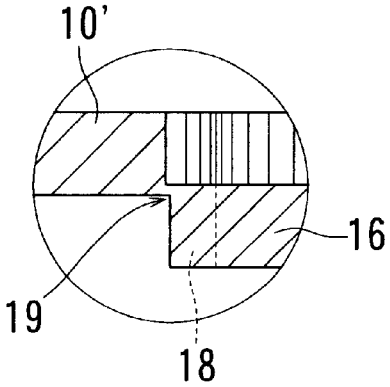
Figure 3:
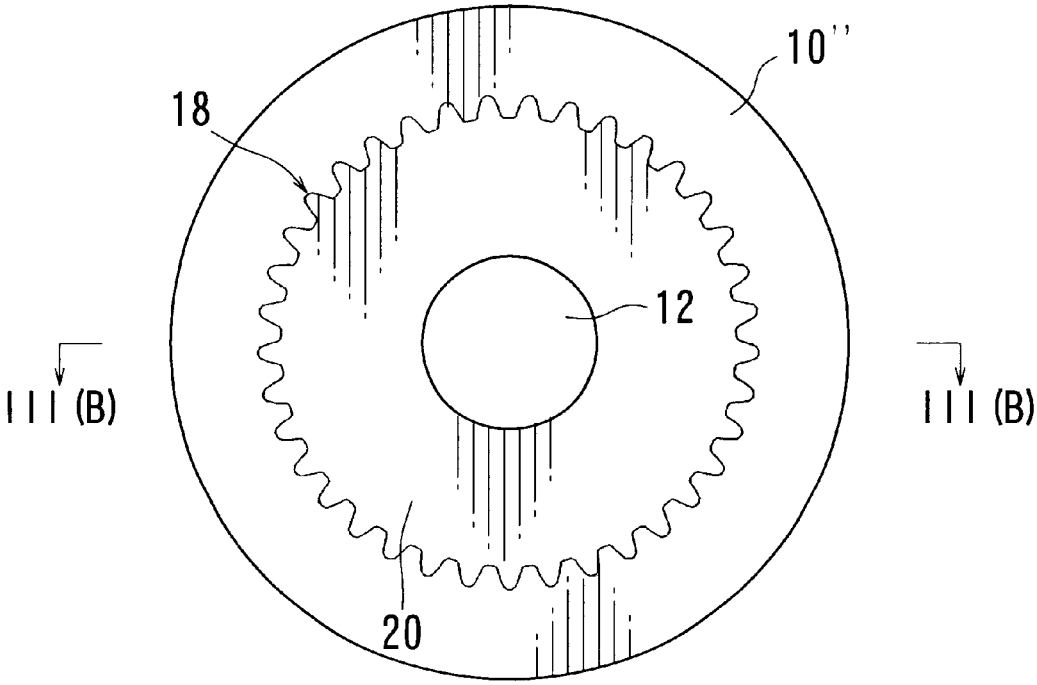
FIG. 3(A) is a plan view of a representative second processed pierced material disk having a second intermediate ring gear defined therein.
FIG. 3(B) is a cross-sectional view taken along line III(B)—III(B) shown in FIG. 3(A)
Figure 3:
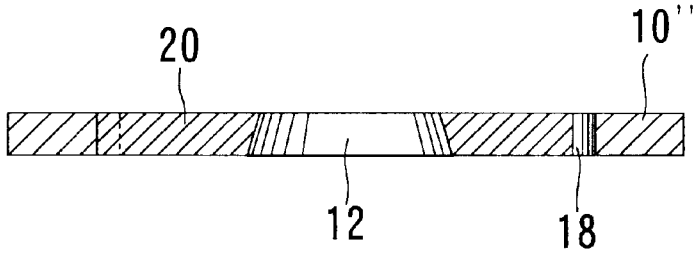
Figure 4:
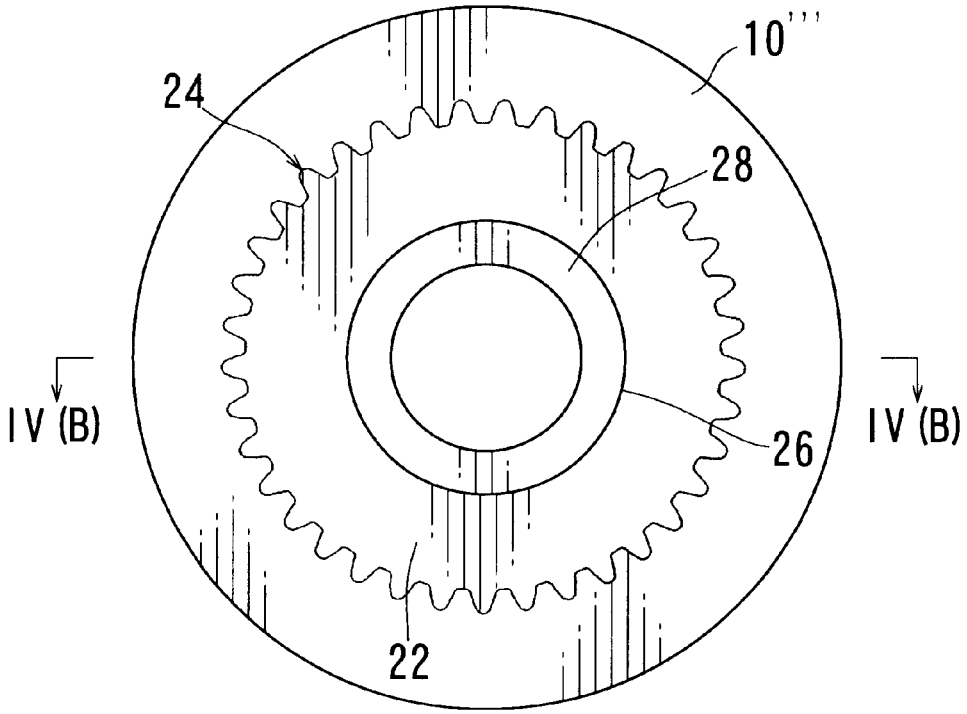
FIG. 4(A) is a plan view of a representative final processed pierced material disk, a ring gear and a waste material.
FIG. 4(B) is a cross-sectional view taken along line IV(B)—IV(B) shown in FIG. 4(A)
Figure 4:
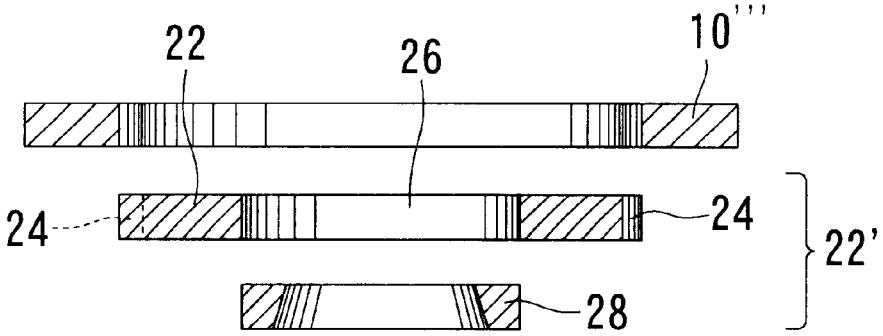
Figure 5:
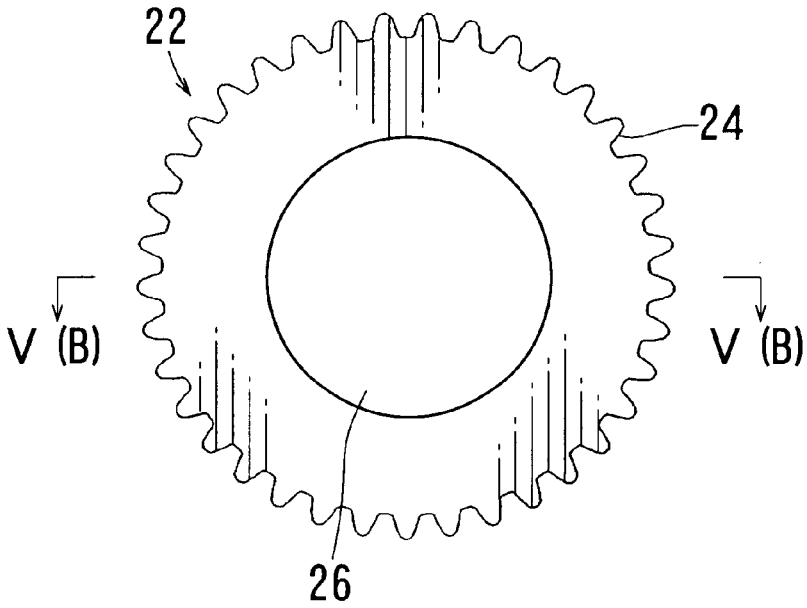
FIG. 5(A) is a plan view of the representative ring gear.
FIG. 5(B) is a cross-sectional view taken along line V(B)—V(B) shown in FIG. 5(A)
Figure 5:
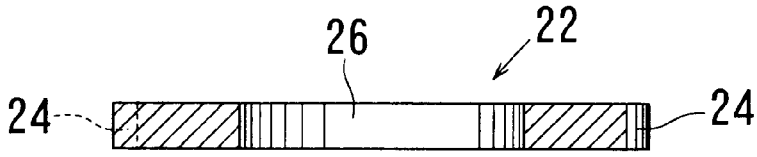
Figure 6:
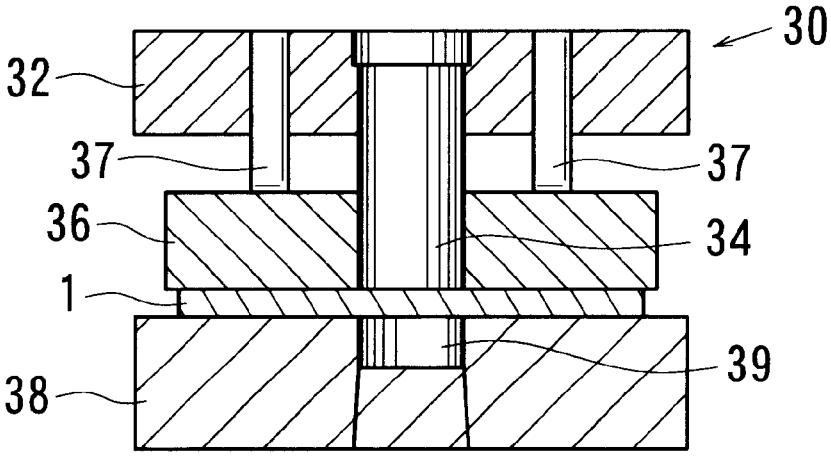
FIG. 6(A) is a vertical, cross-sectional view of a representative piercing machine for forming the pierced material disk from a solid material disk, illustrating a condition in which the solid material disk is disposed between upper and lower dies of the machine.
FIG. 6(B) is a vertical, cross-sectional view of the piercing machine, illustrating a condition in which the solid material disk is stamped out in order to form the pierced material disk.
Figure 6:
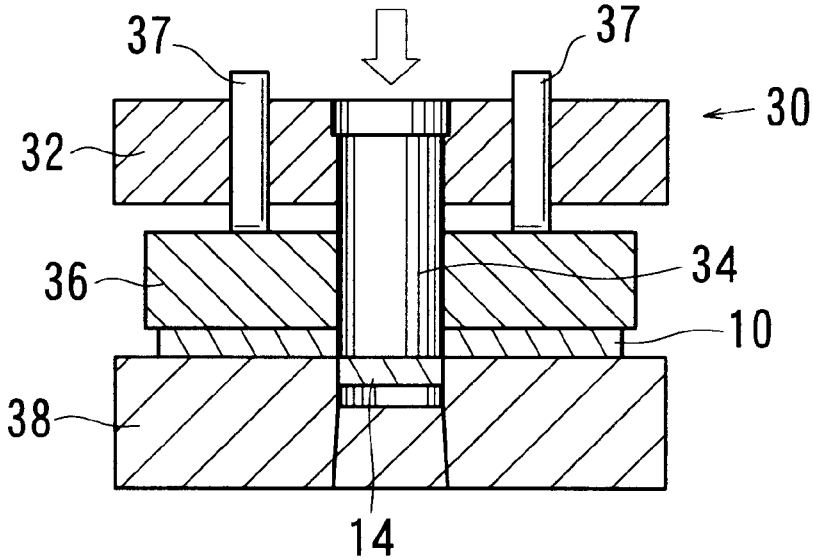
Figure 7:
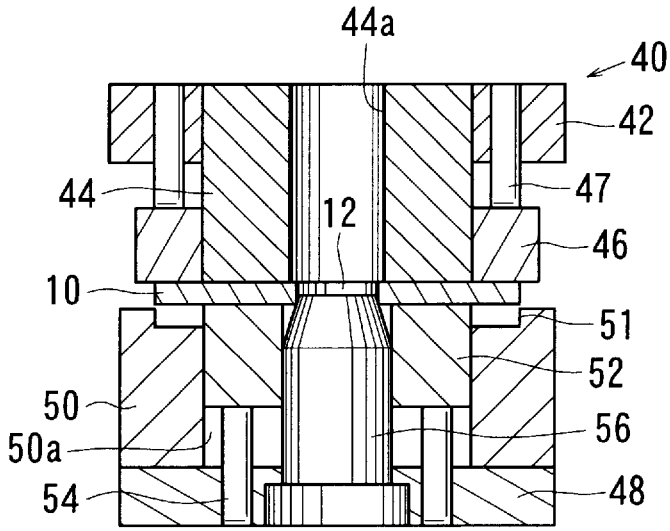
FIG. 7(A) is a vertical, cross-sectional view of a representative trimming machine for forming the first processed pierced material disk, which includes the first intermediate ring gear, from the pierced material disk, illustrating a first step for forming the first processed pierced material disk.
FIG. 7(B) is a vertical, cross-sectional view of the trimming machine, illustrating a second step for forming the first processed pierced material disk.
FIG. 7(C) is a vertical, cross-sectional view of the trimming machine, illustrating a third step for forming the first processed pierced material disk.
Figure 7:
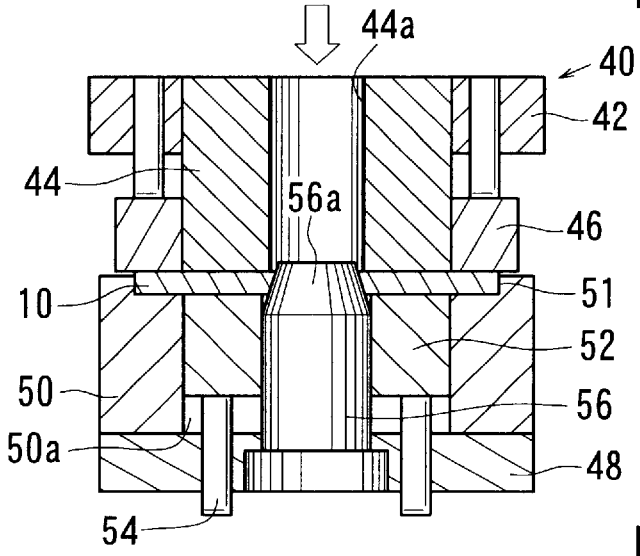
Figure 7:
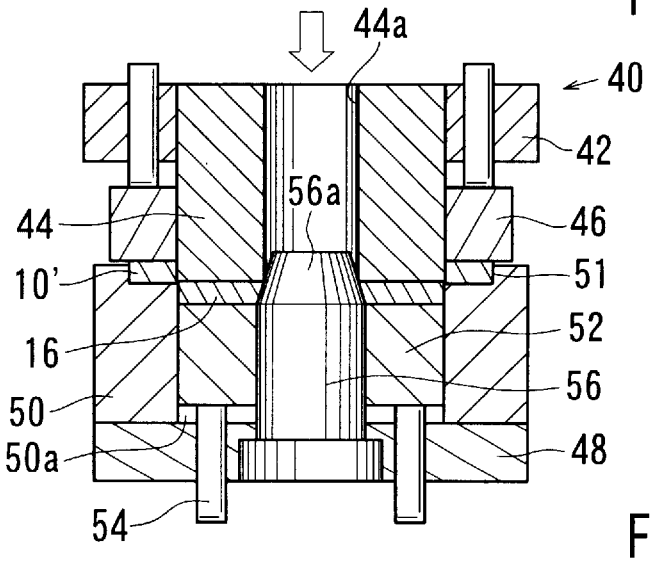

In another embodiment of the present teachings, a pierced material (metal) disk having a guide hole is formed from a solid material disk by utilizing a piercing machine. For example, the solid material disk may be placed and clamped between upper and lower die assemblies of the piercing machine. Thereafter, a punch associated with an upper die of the upper die assembly is moved (e.g., lowered) toward a corresponding die opening defined within a lower die of the lower die assembly. As a result, the solid material disk can be pierced, to thereby form the pierced material disk.

The pierced material disk thus formed may then be further processed by utilizing a trimming machine, to thereby form a first processed pierced material disk having a first intermediate ring gear. For example, the pierced material disk may be placed and clamped between upper and lower die assemblies of the trimming machine. Thereafter, a punch associated with an upper die of the upper die assembly is moved (e.g., lowered) toward a corresponding die opening defined within a lower die of the lower die assembly. As a result, the pierced material disk can be half die cut, to thereby form the first processed pierced material disk, which includes the first intermediate ring gear partially connected to the first processed pierced material disk.

When the pierced material disk is half die cut, a compressor pin associated with a lower die may be forced (e.g. pressed) into the guide hole of the pierced material in order to spread or widen the guide hole. In this case, the first intermediate ring gear of the first processed pierced material disk is outwardly compressed from the guide hole, to thereby induce outward plastic flow caused by plastic deformation therein. The plastic flow will be concentrated on the gear teeth of the first intermediate ring gear. Therefore, the gear teeth of the first intermediate ring gear can be effectively prevented from having dull edges or shear drop.

The first processed pierced material disk thus formed may then be further processed by utilizing a flash pressing machine, to thereby form a second processed pierced material disk having a second intermediate ring gear. For example, the first processed pierced material disk may be placed and clamped between upper and lower die assemblies of the flash pressing machine. Thereafter, a flashing block associated with the upper die assembly may be moved (e.g., lowered) toward a lower die of the lower die assembly. In this case, the first processed pierced material disk can be pushed down such that the first intermediate ring gear is pushed back into the first processed pierced material disk. As a result, the second processed pierced material disk is formed with the second intermediate ring gear.

The second processed pierced material disk thus formed may then be further processed by utilizing a finishing machine, to thereby form a final processed pierced material disk and an unfinished ring gear. For example, the second processed pierced material disk may be placed and clamped between upper and lower die assemblies of the finishing machine. Thereafter, a pusher ring associated with an upper die of the upper die assembly may be moved (e.g., lowered) toward a ring gear ejector ring disposed within a lower die of the lower die assembly. In this case, the second intermediate ring gear can be pushed off or separated from the second processed pierced material disk, to thereby form the unfinished ring gear and the final processed pierced material (waste material).

The unfinished ring gear thus formed may then be processed in the finishing machine, to thereby form a ring gear (final product). For example, a punch associated with the upper die may be moved (e.g., lowered) toward a waste material ejector plate disposed within the ring gear ejector ring. In this case, the unfinished ring gear is stamped out to remove an annular waste material and thereby form the ring gear.

Detailed representative embodiments of the present teachings are shown in FIGS. 1(A)–10(C), in which a ring gear 22 is exemplified as a press formed article that can be prepared utilizing the present teachings. The ring gear 22 is preferably formed by successively processing (e.g., piercing, trimming, flash pressing and finishing) a solid (i.e., non-pierced) material disk 1. The solid material disk 1 is preferably formed from a piece of solid sheet metal (e.g., a sheet of steel) that has a thickness of about 5 mm.

FIGS. 1(A) and 1(B) show a pierced material disk 10. The pierced material disk 10 is preferably formed from the solid metal disk 1 by utilizing a piercing machine 30, a representative example of which is shown in FIGS. 6(A) and 6(B). For example, as best shown in FIG. 1(B), the pierced material disk 10 may be formed by stamping the solid material disk 1 and removing a circular waste material 14. The pierced material disk 10 thus formed includes a central circular guide hole 12.

FIGS. 2(A)–2(C) show a first processed pierced material disk 10' having a first intermediate ring gear 16 defined therein. The first processed pierced material disk 10' is preferably formed from the pierced material disk 10 by utilizing a shear press forming machine or trimming machine 40, a representative example of which is shown in FIGS. 7(A)–7(C). For example, as best shown in FIG. 2(B), the first processed pierced material disk 10' may be formed by half die cutting the pierced material disk 10 around and concentrically with the guide hole 12. As best shown in FIG. 2(A), a plurality of gear teeth 18 is defined around the periphery (circumference) of the first intermediate ring gear 16. In addition, as shown in FIG. 2(C), the first intermediate ring gear 16 has not been completely separated from the first processed material disk 10'. That is, the periphery of the first intermediate ring gear 16 is connected to the first processed material disk 10' via an annular connecting portion 19 that corresponds to the profile of the first intermediate ring gear 16. Further, as best shown in FIG. 2(B), the guide hole 12 will be flared or tapered, because the guide hole 12 will be compressed when the pierced material disk 10 is half die cut, which will be further described below.

FIGS. 3(A) and 3(B) show a second processed pierced material disk 10" having a second intermediate ring gear 20 defined therein. This second processed pierced material disk 10" is preferably formed from the first pierced material disk 10' by utilizing a flash pressing machine 60, a representative example of which is shown in FIGS. 9(A) and 9(B). For example, as best shown in FIG. 3(B), the second processed pierced material disk 10" may be formed by flash pressing the first processed pierced material disk 10' such that the first intermediate ring gear 16 is pressed back into the first processed pierced material disk 10'. As will be recognized by comparing FIGS. 2(A) and 3(A), the second intermediate ring gear 20 has substantially the same shape as the first intermediate ring gear 16. In addition, although this second intermediate ring gear 20 closely or frictionally contacts the second processed material disk 10", it is separate from the second processed material disk 10", because the annular connecting portion 19 is appropriately cut out or removed during the flash pressing step.

FIGS. 4(A) and 4(B) show a final processed pierced material disk 10'" (waste material) and the ring gear 22 (final product) that is released from the final processed pierced material disk 10'". This final processed pierced material disk 10'" and the ring gear 22 are preferably formed from the second pierced material disk 10" by utilizing a finishing machine 80, a representative example of which is shown in FIGS. 10(A)–10(C). For example, as best shown in FIG. 4(B), the final processed pierced material disk 10'" and the ring gear 22 may be formed by pushing out or separating the second intermediate ring gear 20 from the second processed pierced material disk 10". As a result, an unfinished ring gear 22' will be formed with a plurality of completed gear teeth 24 that correspond to the gear teeth 18 of the first and second intermediate ring gears 16, 20. Then, the unfinished ring gear 22' may be stamped in order to remove an annular waste material 28 therefrom and to form a central opening 26.

As shown in FIGS. 5(A) and 5(B), the resulting ring gear 22 is completely separated from the final processed pierced material disk 10'" and includes the central opening 26 and the completed gear teeth 24.

As noted above, the ring gear 22 is preferably formed from a solid metal disk 1 by utilizing the piercing machine 30, the trimming machine 40, the flash pressing machine 60 and the finishing machine 80. Representative apparatus for forming the ring gear 22 will now be further described.

As shown in FIGS. 6(A) and 6(B), the piercing machine 30 may include an upper die assembly that can move with respect to a lower die assembly. The upper die assembly of the piercing machine 30 may include an upper die or clamp ring 36, a punch holder 32 and a punch 34 that is movably disposed within the clamp ring 36. Preferably, the punch 34 is supported by the punch holder 32 and can move relative to the clamp ring 36 in the vertical direction (i.e., in the parallel direction) when the punch holder 32 is moved. In addition, the clamp ring 36 may be coupled to a plurality of hydraulically controlled pressure pins 37, which pins 37 extend through the punch holder 32, so as to be normally biased or forced downwardly. Preferably, the punch 34 is profiled so as to have substantially the same shape as the guide hole 12 of the pierced material disk 10. In addition, cutting edges (not shown) may be disposed or defined around the outer circumference (periphery) of the punch 34.

The lower die assembly of the piercing machine 30 may include an annular lower die 38 having a die opening 39 that is aligned with the punch 34. The die opening 39 is preferably profiled so as to have substantially the same shape as the punch 34. In addition, cutting edges (not shown) are disposed or defined around the inner circumference (periphery) of the lower die 38. Preferably, these cutting edges can engage with the cutting edges of the punch 34.

As shown in FIGS. 7(A)–7(C), the trimming machine 40 may include an upper die assembly that can move with respect to a lower die assembly. The upper die assembly of the trimming machine 40 may include an upper die or clamp ring 46, a punch 44 that is movably disposed within the clamp ring 46, and a punch holder 42. Preferably, the punch 44 is supported by the punch holder 42 and can move relative to the clamp ring 46 in the vertical direction (i.e., in the parallel direction). In addition, the clamp ring 46 may be coupled to a plurality of hydraulically controlled pressure pins 47, which pins 47 extend through the punch holder 42, so as to be normally biased or forced downwardly. The punch 44 may include a longitudinal cylindrical inner bore 44*a* that is profiled so as to substantially correspond to the guide hole 12 of the pierced material disk 10. As best shown in FIG. 7(A), the inner bore 44*a* preferably has a diameter that is slightly greater or larger than the guide hole 12.

The lower die assembly of the trimming machine 40 may include an annular lower die 50 disposed on a lower die holder 48. A die opening 50*a* may be defined within the lower die 50 and the die opening 50*a* is preferably aligned with the punch 44 and profiled so as to have substantially the same shape as the punch 44. In addition, gear teeth forming edges (not shown) may be disposed or defined around the inner circumference (periphery) of the lower die 50. Further, an annular recess 51 may be defined on the upper surface of the lower die 50 so as to closely receive the peripheral edge of the pierced material disk 10. Preferably, the annular recess 51 is concentrically positioned or defined with respect to the die opening 50*a*.

The lower die assembly may further include an ejector ring 52 that is closely and vertically movably received within the die opening 50*a*. The ejector ring 52 may be coupled to a plurality of hydraulically controlled pressure pins 54, so as to be upwardly biased or forced. Preferably, the ejector ring 52 is designed so as to be normally coplanar with the lower die 50.

The lower die assembly may further include a compressor pin 56 that is disposed on the lower die holder 48 and upwardly projects through the ejector ring 52. As best shown in FIG. 7(A), although the compressor pin 56 has a larger diameter than the guide hole 12 of the pierced material disk 10, its upper end portion 56*a* is preferably tapered, so as to have substantially the same diameter as the guide hole 12.

As shown in FIGS. 9(A) and 9(B), the flash pressing machine 60 may include an upper die assembly that can move with respect to a lower die assembly. The upper die assembly of the flash pressing machine 60 may include an upper die or flashing block 64 and a block holder 62. Preferably, the flashing block 64 can move relative to the flashing block holder 62 in the vertical direction (i.e., in the parallel direction). In addition, the flashing block 64 may be coupled to a plurality of hydraulically controlled pressure pins 66, which pins 66 extend through the block holder 62, so as to be normally biased or forced downwardly.

The lower die assembly of the flash pressing machine 60 may include an annular lower die 72, a support block 70 and a block holder 68. The annular lower die 72 is preferably profiled so as to closely receive the first intermediate ring gear 16 of the first processed pierced material block 10'. The support block 70 is disposed on the block holder 68 and is received within the lower die 72. Further, the lower die 72 can move relative to the support block 70 in the vertical (parallel) direction. In addition, the lower die 72 may be coupled to a plurality of hydraulically controlled pressure pins 74, so as to be normally biased or forced upwardly.

As shown in FIGS. 10(A)–10(C), the finishing machine 80 may include an upper die assembly that can move with respect to a lower die assembly. The upper die assembly of the finishing machine 80 may include an upper die or clamp ring 88, a pusher ring 86 that is movably disposed within the clamp ring 88, a punch 84 that is movably disposed within the pusher ring 86, and a punch holder 82. Preferably, the punch 84 is supported by the punch holder 82 and can move relative to the pusher ring 86 and the clamp ring 88 in the vertical direction (i.e., in the parallel direction) when the punch holder 82 is moved. In addition, the pusher ring 86 may be coupled to a plurality of hydraulically controlled pressure pins 87, which pins 87 extend through the punch holder 82, so as to be normally biased or forced downwardly. The clamp ring 88 may also be coupled to a plurality of hydraulically controlled pressure pins 89, which pins 89 extend through the punch holder 82, so as to be normally biased or forced downwardly. Preferably, the pusher ring 86 may be profiled so as to substantially correspond to the second intermediate ring gear 20 of the second processed pierced material disk 10'. Furthermore, the punch 84 is preferably profiled so as to have substantially the same shape as the central opening 26 of the ring gear 22.

The lower die assembly of the finishing machine 80 may include an annular lower die 92 that is disposed on a lower die holder 90. The lower die 92 is preferably profiled so as to substantially correspond to the second intermediate ring gear 20 of the second processed pierced material block 10". In addition, gear teeth forming edges (not shown) for forming the completed gear teeth 24 may be defined around the inner circumference (periphery) of the lower die 92. The lower die assembly may further include a ring gear ejector ring 94 that is closely and vertically movably received within the lower die 92, and a waste material ejector plate 96 that is closely and vertically movably received within the ring gear ejector ring 94. The ejector ring 94 may be coupled to a plurality of hydraulically controlled pressure pins 95, so as to be upwardly biased or forced. Preferably, the ring gear ejector ring 94 is designed so as to be normally coplanar with the lower die 92. Similarly, the waste material ejector plate 96 may be coupled to a plurality of hydraulically controlled pressure pins 97, so as to be upwardly biased or forced. Preferably, the waste material ejector plate 96 is designed so as to be normally coplanar with the lower die 92.

A representative method for manufacturing the ring gear 22 using the representative machines 30, 40, 60 and 80 will now be described. As shown in FIG. 6(A), the solid material disk 1 may be first disposed on the lower die 38 of the lower die assembly of the piercing machine 30. Subsequently, the upper die assembly may be lowered in order to clamp the solid material disk 1 between the lower die 38 and the clamp ring 36 of the upper die assembly.

Although the solid material disk 1 may be formed by a variety of known methods, the solid material disk 1 is preferably formed by stamping out a metal plate having a desired thickness. The metal plate may preferably be a steel plate (e.g., a boron-doped carbon steel plate) and known techniques for cold press forming may be utilized with the present teachings.

As shown in FIG. 6(B), the punch 34, which is movably received within the clamp ring 36, is then extended or projected (e.g., lowered) toward the die opening 39 defined within the lower die 36. As a result, the punch 34 will cooperate with the lower die in order to stamp the solid material disk 1 and remove the circular waste material 14 from the solid material disk 1. As a result, the pierced material disk 10 will be formed with the central circular guide hole 12, as shown in FIGS. 1(A) and (B).

As shown in FIG. 7(A), the resulting pierced material disk 10 may then be disposed on the ejector ring 52 of the lower die assembly of the trimming machine 40. Subsequently, the upper die assembly may be lowered in order to clamp the pierced material disk 10 between the ejector ring 52 and the clamp ring 46 of the upper die assembly.

Thereafter, as shown in FIG. 7(B), the upper die assembly may be lowered toward the lower die assembly. As a result, the pierced material disk 10 will be pressed downwardly by the punch 44 and the clamp ring 46 against the upward reactive force of the ejector ring 52 and the pierced material disk 10 will be forced into the annular recess 51 of the lower die 50. Therefore, the pierced material disk 10 will be clamped between the punch 44 and the clamp ring 46 of the upper die assembly and the ejector ring 52 and the lower die 50 of the lower die assembly. At this time, the tapered upper end portion 56*a* of the compressor pin 56 may be forced into the guide hole 12 of the pierced material disk 10 in order to taper or spread the guide hole 12. In this case, the pierced material disk 10 will be compressed outwardly from the tapered guide hole 12, thereby causing outward plastic flow due to plastic deformation therein. However, the outer periphery of the pierced material disk 10 can not, in fact, outwardly deform, because the outer periphery of the pierced material disk 10 is closely received within the annular recess 51. That is, the annular recess 51 restricts or prevents outward deformation of the outer periphery of the pierced material disk 10.

Subsequently, as shown in FIG. 7(C), the punch holder 42 may be lowered toward the lower die assembly. At this time, only the punch 44 supported by the punch holder 42 projects into the die opening 50*a* of the lower die 50 against the upward reactive force of the ejector ring 52. As a result, the pierced material disk 10 will effectively be half die cut or trimmed by the punch 44, to thereby form the first processed pierced material disk 10' having the first intermediate ring gear 16 defined therein, as shown in FIGS. 2(A)–2(C). As shown in FIG. 2(C), the periphery of the first intermediate ring gear 16 is connected to the first processed material disk 10' via the annular connecting portion 19. Further, the gear teeth 18 are defined around the periphery of the first intermediate ring gear 16, as shown in FIG. 2(A). When the pierced material disk 10 is half die cut, the tapered upper end portion 56*a* of the compressor pin 56 is further forced into the guide hole 12 such that the guide hole 12 will be further spread or widened. As a result, the first intermediate ring gear 16 of the first processed pierced material disk 10' is outwardly compressed from the guide hole 12, thereby causing outward plastic flow due to plastic deformation therein.

Generally speaking, after only about 30% of the thickness of the pierced material disk 10 has been half die cut, shearing has a tendency of causing the gear teeth 18 of the first intermediate ring gear 16 to have dull edges or shear drop. However, as noted above, the outward plastic flow caused by plastic deformation is preferably generated in the first intermediate ring gear 16. Such plastic flow is effectively prevented from being directed toward the peripheral edge of the pierced material disk 10 via the connecting portion 19 and is concentrically directed to the gear teeth 18, because the peripheral edge of the pierced material disk 10 is closely received within the annular recess 51. Therefore, the gear teeth 18 may preferably be prevented from having such shear drop.

Further, in order to reliably form the annular connecting portion 19 (FIG. 2(C)) that interconnects the first intermediate ring gear 16 and the first processed pierced material disk 10', the punch holder 42 is appropriately controlled such that a forward end surface of the punch 44 is stopped immediately above a bottom surface of the annular recess 51 of the lower die 50. In addition, the outer diameter of the punch 44 is preferably greater or larger than the inner diameter of the die opening 50*a* of the lower die 50. In other words, the outer diameter of the punch 44 is designed so as to be greater or larger than the outer diameter of the first intermediate ring gear 16.

The step for forming the first processed pierced material disk 10' and the first intermediate ring gear 16 by utilizing the trimming machine 40 will be herein referred to as a "first step" for forming the ring gear 22.

Figure 8:
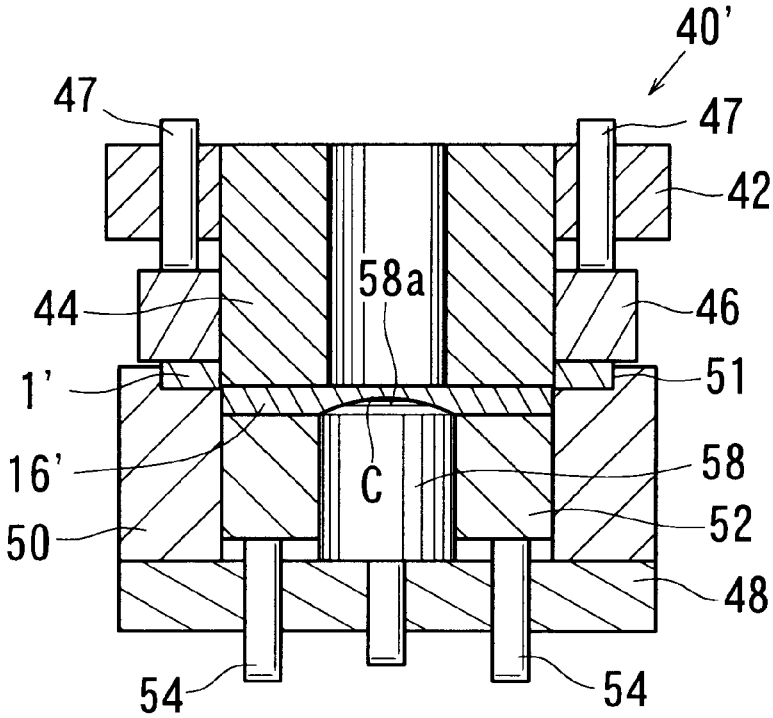
FIG. 8 is a vertical, cross-sectional view of another representative trimming machine for forming another representative first processed pierced material disk from a non-pierced material disk, illustrating a step similar to FIG. 7(C)
Figure 9:
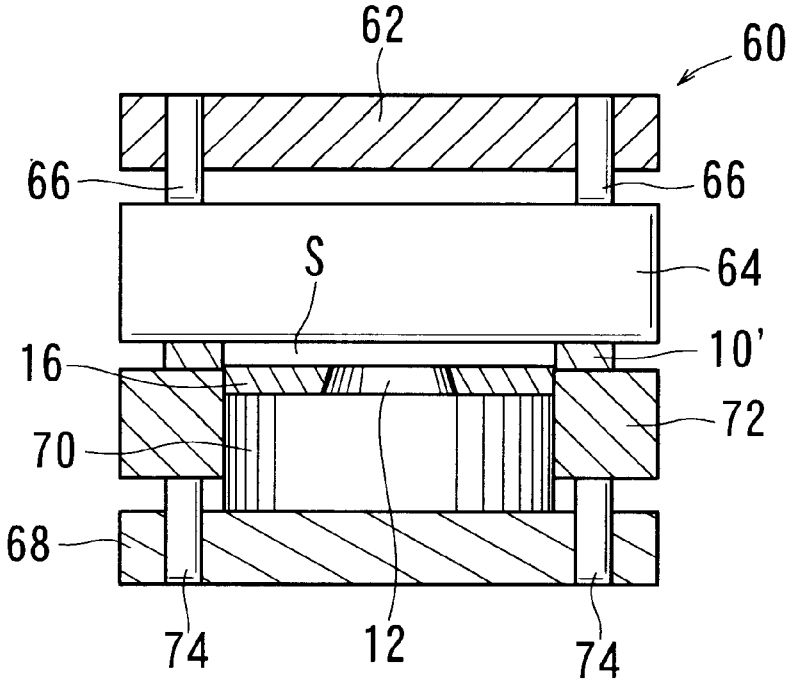
FIG. 9(A) is a vertical, cross-sectional view of a representative flash pressing machine for forming the second processed pierced material disk, which includes the second intermediate ring gear, from the first processed pierced material disk, illustrating a condition in which the first processed pierced material disk is disposed between upper and lower dies of the machine.
FIG. 9(B) is a vertical, cross-sectional view of the flash pressing machine, illustrating a condition in which the first processed pierced material disk is pressed in order to form the second processed pierced material disk.
Figure 9:
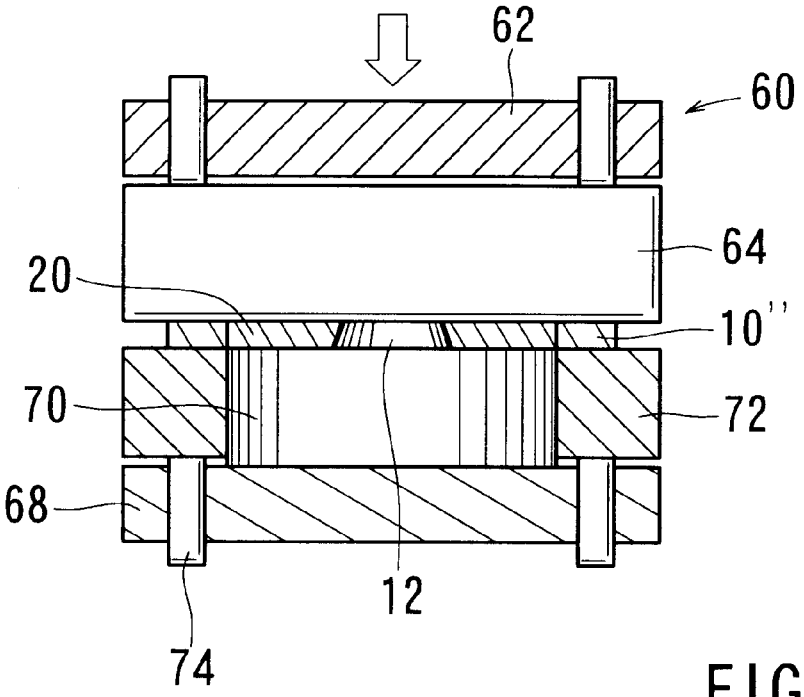
Figure 10:
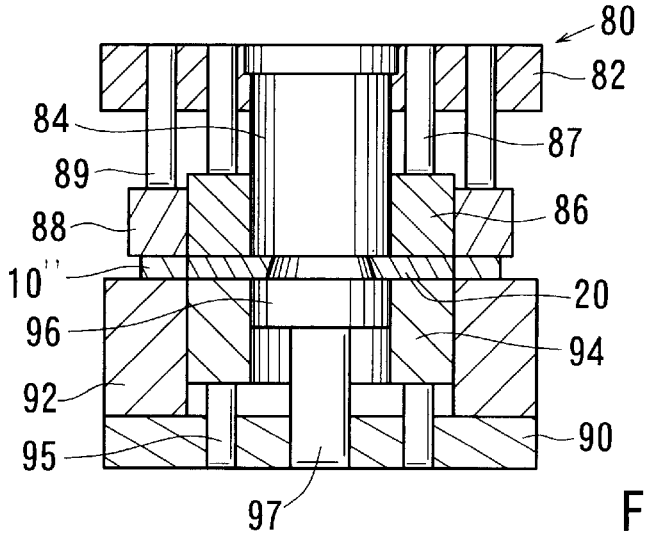
FIG. 10(A) is a vertical, cross-sectional view of a representative finishing machine for forming the final processed pierced material disk and the ring gear from the second processed pierced material disk, illustrating a first step for forming the final processed pierced material disk.
FIG. 10(B) is a vertical, cross-sectional view of the finishing machine, illustrating a second step for forming the final processed pierced material disk.
FIG. 10(C) is a vertical, cross-sectional view of the finishing machine, illustrating a third step for forming the final processed pierced material disk.
Figure 10:
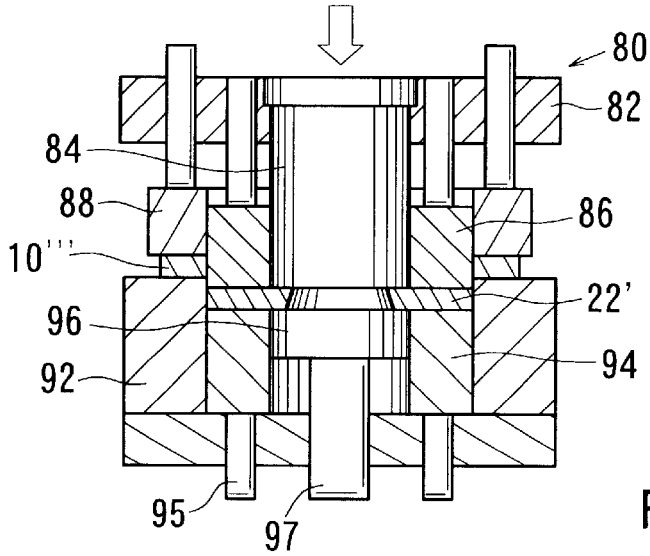
Figure 10:
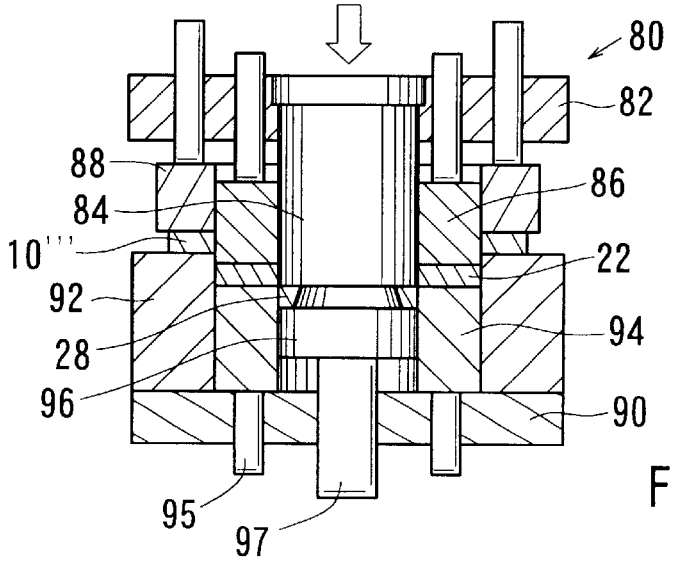

Further, in the first step for forming the ring gear 22, the solid material disk 1 can be directly used without processing or piercing. In other words, the solid material disk 1 can be substituted for the pierced material disk 10. In such case, a modified trimming machine 40' may be utilized instead of the trimming machine 40, which modified trimming machine 40' is shown in FIG. 8. As will be apparent from FIG. 8, compressor pin 58 is substituted for the compressor pin 56 in the modified trimming machine 40'. The compressor pin 58 simply differs from the compressor pin 56 in that its upper end portion 58*a* is convexly rounded and is not tapered.

By utilizing the modified trimming machine 40' to process the solid material disk 1, the solid material disk 1 can effectively be half die cut or trimmed by the punch 44, to thereby form a first processed solid material disk 1' having a modified first intermediate ring gear 16', as shown in FIG. 8. Further, when the solid material disk 1 is half die cut, the rounded upper end portion 58*a* of the compressor pin 58 is upwardly forced through a central portion C of the solid material disk 1 in order to depress or compress the same. As a result, similar to the first intermediate ring gear 16 of the first processed pierced material disk 10', the modified first intermediate ring gear 16' of the first processed solid material disk 1' is outwardly compressed from the disk central portion C, to thereby cause outward plastic flow due to plastic deformation therein. Therefore, generation of shear drop in the gear teeth (not shown) of the modified first intermediate ring gear 16' can be prevented.

As shown in FIG. 9(A), the first processed pierced material disk 10' thus formed may then be disposed on the annular lower die 72 of the flash pressing machine 60 such that the first intermediate ring gear 16 is received therein. Subsequently, the upper die assembly is lowered, so that the first processed pierced material disk 10' is clamped between the lower die 72 and the flashing block 64 of the upper die assembly. As will be apparent from FIG. 9(A), at this time, a space S may be defined between the first intermediate ring gear 16 and the flashing block 64.

Subsequently, as shown in FIG. 9(B), the block holder 62 may be lowered toward the lower die assembly, so that the flashing block 64 will be downwardly forced or pressed against the upward reactive force of the lower die 72. In this case, the first processed pierced material disk 10' is pushed down, because the first intermediate ring gear 16 is immovably (fixedly) supported on the support block 70. Preferably, the block holder 62 is continuously lowered until the space S disappears. As a result, the first processed pierced material disk 10' will be pushed down such that the first intermediate ring gear 16 is pushed back into the first processed pierced material disk 10'. Thus, the second processed pierced material disk 10" can be formed with the second intermediate ring gear 20, as shown in FIGS. 3(A) and 3(B).

When the first intermediate ring gear 16 is pressed back into the first processed pierced material disk 10', the connecting portion 19 is successively deformed and shear cut. Therefore, burrs or fins are not formed around the gear teeth 18 of the second intermediate ring gear 20.

The step for forming the second processed pierced material disk 10" and the second intermediate ring gear 20 by utilizing the flash pressing machine 60 will be herein referred to as a "second step" for forming the ring gear 22.

As shown in FIG. 10(A), the second processed pierced material disk 10" thus formed may then be disposed on the lower die 92 of the lower die assembly of the finishing machine 80. Preferably, the second intermediate ring gear 20 is aligned with the ring gear ejector ring 94. Subsequently, the upper die assembly may be lowered in order to clamp the second processed pierced material disk 10" between the lower die 92 and the clamp ring 88 of the upper die assembly.

Thereafter, as shown in FIG. 10(B), the punch holder 82 of the upper die assembly is lowered toward the lower die assembly. At this time, the punch 84 and the pusher ring 86, which are supported by the punch holder 82, will extend or project into the lower die 92 against the upward reactive force of the ejector ring 94 and the waste material ejector plate 96 until the ejector ring 94 contacts the lower die holder 90. As a result, the second intermediate ring gear 20 will be pushed off or separated from the second processed pierced material disk 10" into the lower die 92, to thereby form the final processed pierced material disk 10''' and the unfinished ring gear 22' having the completed gear teeth 24. At this time, the completed gear teeth 24 of the unfinished ring gear 22' will engage the gear teeth forming edges (not shown) defined on the inner circumference of the lower die 92.

Thereafter, as shown in FIG. 10(C), the punch holder 82 of the upper die assembly may be further lowered toward the lower die assembly. At this time, only the punch 84 supported by the punch holder 82 projects or extends into the ejector ring 94 against the upward reactive force of the ejector plate 96, because the pusher ring 86 is prevented by the ejector ring 94 from downwardly moving. As a result, the unfinished ring gear 22' is stamped out by the punch 84 in order to remove the annular waste material 28 therefrom. Consequently, the ring gear 22 (final product) is formed with the central opening 26 and the completed gear teeth 24.

After completing the finishing operation, the upper die assembly is returned to its resting position (e.g., upwardly lifted), so that the clamp ring 86 and the punch 84 can be removed from the lower die 92. At this time, the ejector ring 94 and the waste material ejector plate 96 may upwardly return due to the hydraulic force of the pressure pins 95, 97, to thereby eject the ring gear 22 and the waste material 28 from the lower die 92.

The step for forming the final processed pierced material disk 10''' and the ring gear 22 by utilizing the finishing machine 80 will be herein referred to as a "third step" for forming the ring gear 22.

Although the ring gear 22 was produced as the final product in this representative embodiment, the unfinished ring gear 22' also can be used as the final product, if necessary.

According to the present methods, dull edges or shear drops are not substantially produced in the first intermediate ring gear 16 during the trimming process, because the gear teeth 18 of the first intermediate ring gear 16 may preferably be prevented from producing shear drops due to the plastic flow induced therein. Therefore, it is not necessary to raise the shear drop after the first intermediate ring gear 16 is formed. As a result, the present methods enable efficient production of a superior quality ring gear 22.

Representative examples of the present teachings have been described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present teachings.

What is claimed is:

1. A method for manufacturing a press formed article, comprising:

half die cutting a substantially flat material by press forming, thereby forming a first processed material having a first intermediate press formed article defined therein, wherein the half die cutting step is performed while simultaneously compressing a central portion of the substantially flat material in order to induce outward plastic flow within the first intermediate press formed article;

pressing the first intermediate press formed article back into the first processed material, thereby forming a second processed material having a second intermediate press formed article defined therein.

2. A method as defined in claim 1, further comprising:

separating the second intermediate press formed article from the second processed material, thereby forming a final processed material and an unfinished press formed article.

3. A method as defined in claim 2, wherein the separating step further comprises stamping the unfinished press formed article to form an opening within the unfinished press formed article.

4. An apparatus for manufacturing a press formed article, comprising:

means for half die cutting a substantially flat material in order to form a first processed material having a first intermediate press formed article defined therein, and means for simultaneously compressing a central portion of the substantially flat material when the substantially flat material is half die cut, to thereby induce outward plastic flow within the first intermediate press formed article; and means for pressing the first intermediate press formed article back into the substantially flat material, to thereby form a second processed material having a second intermediate mess formed article defined therein.

5. An apparatus as defined in claim 4 further comprising:

means for closely receiving the substantially flat material when the substantially flat material is half die cut in order to concentrate the outward plastic flow towards a peripheral edge of the first intermediate press formed article.

6. An apparatus as defined in claim 4 further comprising:

means for separating the second intermediate press formed article from the second processed material, to thereby form a final processed material and an unfinished press formed article.

7. An apparatus as defined in claim 6 further comprising:

means for stamping the unfinished press formed article to form an opening within the unfinished press formed article.

8. A method, comprising:

clamping a substantially flat material between an upper die and a lower die of a trimming machine, pushing a punch associated with the upper die of the trimming machine into the lower die of the trimming machine and half die cutting the material, thereby forming a first processed material having a first intermediate press formed article defined therein, wherein the half die cutting step is performed while simultaneously compressing a central portion of the substantially flat material in order to induce outward plastic flow within the first intermediate press formed article, clamping the first processed material between an upper die and a lower die of a flash pressing machine, pushing the upper die of the flash pressing machine into the lower die of the flash pressing machine, thereby fanning a second processed material having a second intermediate press formed article defined therein, clamping the second processed material between an upper die and a lower die of a finishing machine, and pushing a pusher associated with the upper die of the finishing machine into the lower die of the finishing machine, thereby forming a final processed material and an unfinished press formed article.

9. A method as defined in claim 8, wherein the half die cutting step further comprises forming a plurality of gear teeth around a periphery of the first intermediate press formed article and concentrating the outward plastic flow towards the gear teeth.

10. An apparatus, comprising:

means for clamping a substantially flat material between an upper die and a lower die of a trimming machine, means for pushing a punch associated with the upper die of the trimming machine into the lower die of the trimming machine and half die cutting the material, thereby forming a first processed material having a first intermediate press formed article defined therein, the pushing means comprising means for simultaneously compressing a central portion of the substantially flat material when the punch is pushed, to thereby induce outward plastic flow within the first intermediate press formed article, means for clamping the first processed material between an upper die and a lower die of a flash pressing machine, means for pushing the upper die of the flash pressing machine into the lower die of the flash pressing machine, thereby forming a second processed material having a second intermediate press formed article defined therein, means for clamping the second processed material between an upper die and a lower die of a finishing machine, and means for pushing a pusher associated with the upper die of the finishing machine into the lower die of the finishing machine, thereby forming a final processed material and an unfinished press formed article.

11. An apparatus as defined in claim 10, further comprising means for forming a plurality of gear teeth around a periphery of the first intermediate press formed article and means for concentrating the outward plastic flow toward the gear teeth.

12. A method for manufacturing a press formed article, comprising:

half die cutting a substantially flat material by press forming, thereby forming a first processed material having a first intermediate press formed article defined therein, wherein the half die culling step is performed while simultaneously compressing a central portion of the substantially flat material in order to induce outward plastic flow within the first intermediate press formed article, and wherein the half die cutting step further comprises forming a plurality of gear teeth around a periphery of the first intermediate press formed article and concentrating the outward plastic flow towards the gear teeth.

13. An apparatus for manufacturing a press formed article, comprising:

means for half die cutting a substantially flat material in order to form a first processed material having a first intermediate press formed article defined therein, means for simultaneously compressing a central portion of the substantially flat material when the substantially flat material is half die cut, to thereby induce outward plastic flow within the first intermediate press formed article, means for forming a plurality of gear teeth around a periphery of the first intermediate press formed article, and means for concentrating the outward plastic flow toward the gear teeth.

* * * * *